United States Patent [19]

Stewart

[11] 3,937,437

[45] Feb. 10, 1976

[54] FLUSH MOUNTING DRIVE ANCHOR

[76] Inventor: Ned L. Stewart, 2816 Blue Ridge, Mesquite, Tex. 75149

[22] Filed: Nov. 21, 1974

[21] Appl. No.: 525,873

Related U.S. Application Data

[63] Continuation-in-part of Ser. No. 454,004, March 22, 1974.

[52] U.S. Cl. ..... 248/499; 52/155

[51] Int. Cl.[2] ..... E06B 3/54; E04B 5/52

[58] Field of Search ..... 24/265 CD, 269, 68 CD, 24/68 B; 52/155, 156, 157, 158, 159, 160, 161, 165, 23; 248/499

[56] References Cited

UNITED STATES PATENTS

| | | | |
|---|---|---|---|
| 269,018 | 12/1882 | Crowell et al. | 52/23 |
| 2,932,871 | 4/1960 | Phillips et al. | 24/136 |
| 2,997,761 | 8/1961 | Davis | 24/136 UX |
| 3,075,252 | 1/1963 | King | 52/157 X |
| 3,809,346 | 5/1974 | Jackson | 248/44 |

FOREIGN PATENTS OR APPLICATIONS

| | | | |
|---|---|---|---|
| 867,153 | 10/1941 | France | 52/155 |
| 823,336 | 11/1952 | Germany | 52/155 |

*Primary Examiner*—J. Franklin Foss

[57] ABSTRACT

Disclosed is an anchoring apparatus for use in anchoring structures to the ground by use of elongated flexible straps. The anchoring apparatus has a lower ground engaging portion which is embedded in the ground below ground level, and an internally-threaded fastener is provided on the ground-engaging portion. A threaded shaft is releasably attached to the fastener of the ground-engaging portion. An upper portion is attached to the threaded shaft for attaching the straps to the shaft. The upper portion is provided with two anchorheads. Each head has first and second flanges extending at an angle with respect to each other. One of the flanges is provided with a bore through which the shaft extends. The other of the flanges is provided with an elongated slot with a flat-sided bar attached to extend across the slot.

5 Claims, 7 Drawing Figures

FLUSH MOUNTING DRIVE ANCHOR

BACKGROUND OF THE INVENTION

The present application is a continuation-in-part of application Ser. No. 454,004, entitled "Anchoring Apparatus", filed March 22, 1974, for Ned L. Stewart.

The present invention relates to improvements in apparatus for use in anchoring structures, and the like, and more particularly, to a new and improved anchoring apparatus which can be dismanteled to remove the portions extending above ground surface so that the wheels of the vehicle may pass thereover without damage thereto.

In the installation of structures, such as mobile homes, portable buildings, and the like, it has been a common practice to anchor these structures in place for purposes of safety. To accomplish this, anchoring apparatus are embedded in the ground and the structures are attached to these apparatus by means of flexible metal straps, and the like. Although these systems have operated to effectively hold such structures in place, considerable difficulty has been experienced in removing these anchors from the ground so that the structures can be moved. In particular, these anchors, if left in the ground, project above the ground and can damage the wheels of a vehicle used to move the structure.

Therefore, the general purpose of the present invention is to provide an improved anchoring apparatus which has all the advantages of similarly-employed prior art anchoring apparatus, and yet provides an improved apparatus which can be easily disassembled to remove the portions projecting above the surface of the ground. To attain this, the present invention contemplates the use of a combination of an improved drive-type anchorhead which has a socket portion thereon for receiving a threaded shaft which can be attached thereto. The threaded shaft can be removed when it is desired to move a vehicle over the embedded portion.

The objects and many attendant advantages of the present invention will be readily understood by those of ordinary skill in the art as the same becomes better understood by reference to the following detailed description when considered in connection with the accompanying Drawings in which:

DETAILED DESCRIPTION

Figure 1:
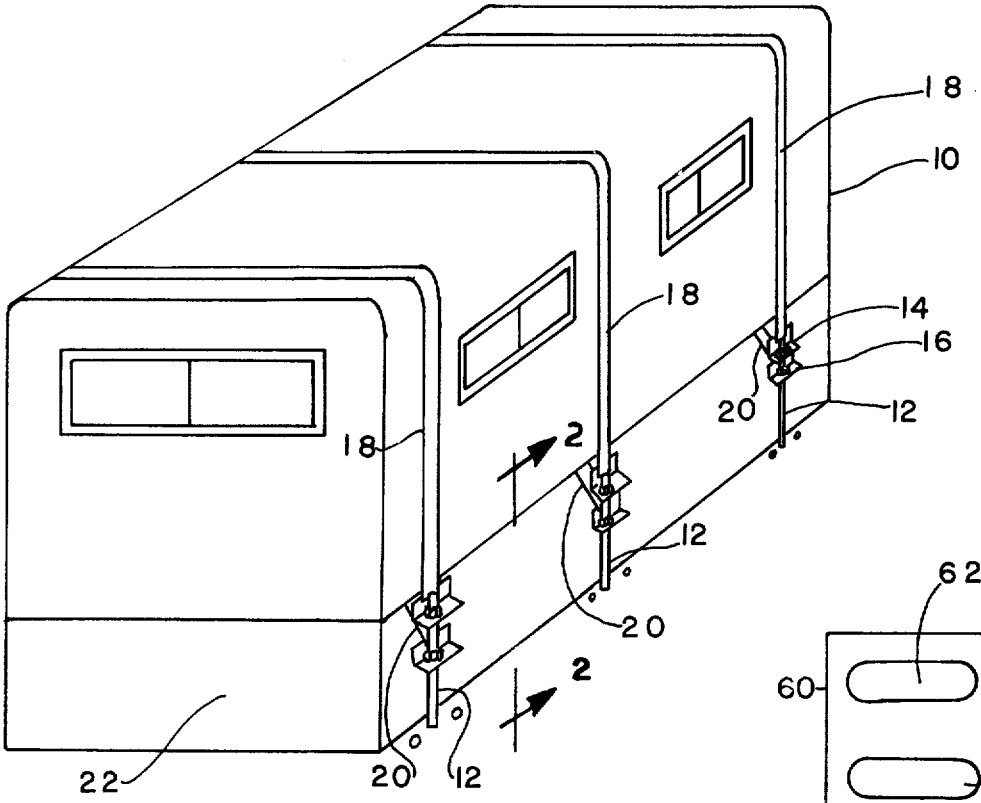
FIG. 1 is a perspective view of a mobile home anchored in place by the improved anchoring apparatus of the present invention.

Referring now to the Drawings, wherein like reference characters designate like or corresponding parts throughout the several views, there is illustrated in FIG. 1, a mobile home 10 anchored in place by the improved anchors 12 of the present invention. As can be seen, three anchors are illustrated on one side of the mobile home 10 and it is to be understood, of course, that an equal number of anchors 12 will be present on the opposite side. The anchors 12 are each provided with two heads 14 and 16 used to attach steel straps 18 and 20, respectively, to the mobile home. The strap 18 is attached to the upper head 14 and extends over the top of the mobile home 10 and is connected to similar anchor 12 on the opposite side of home 10. The strap 20 is connected to the frame of the mobile home, as will be hereinafter described in detail. A skirt 22 is provided around the mobile home to enclose a space under the mobile home.

Figure 2:
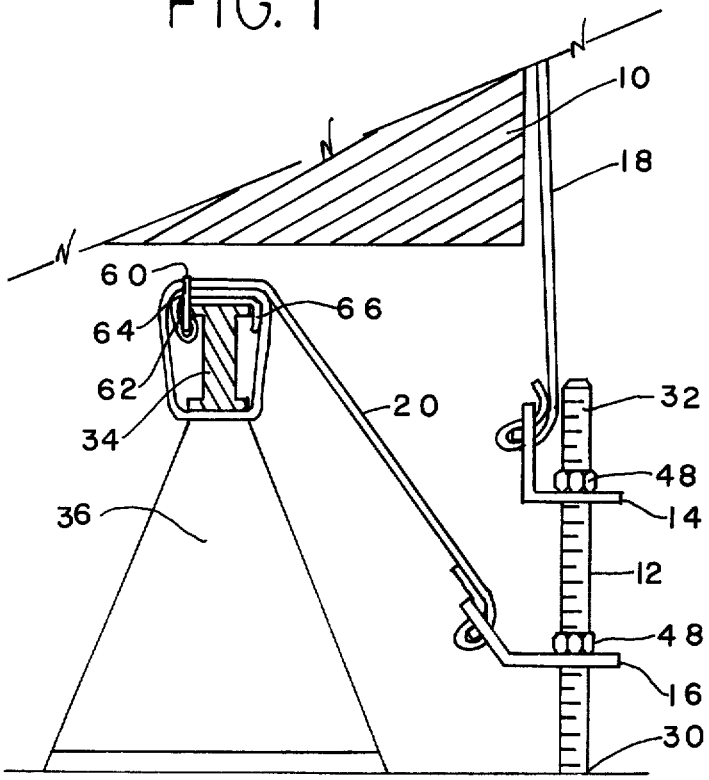
FIG. 2 is a section view taken on line 2—2 of FIG. 1, looking in the direction of the arrows.
Figure 3:
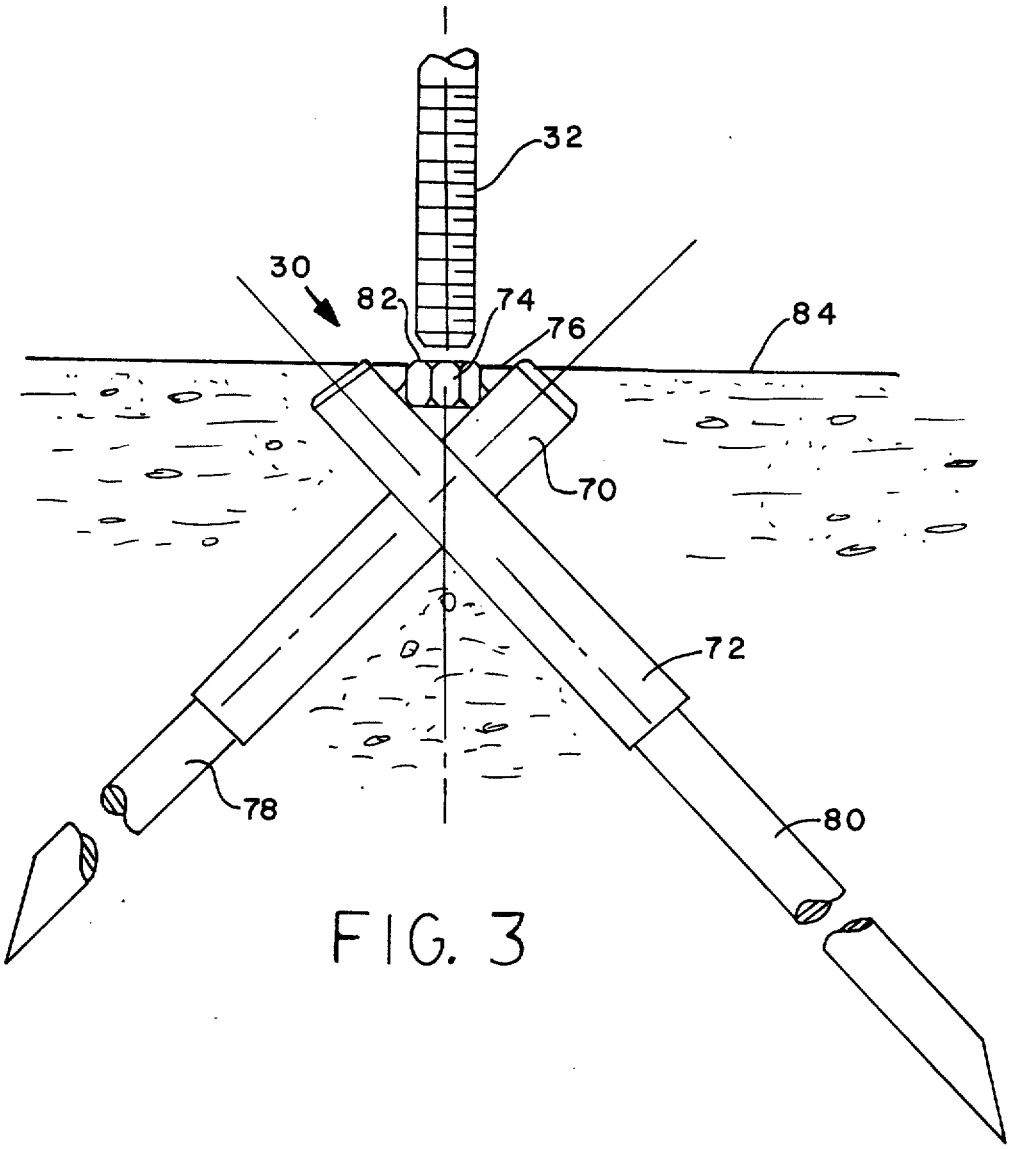
FIG. 3 is a section view illustrating the lower portion embedded in the ground with the drive anchors in place therein.

The details of the anchor 12 are best illustrated in FIGS. 2 and 3. The anchor 12 has a lower portion 30 embedded in the ground and used to attach the anchor to the ground. A threaded shaft 32 is removably connected to the lower portion 30 and extends vertically in an upward direction. Anchorheads 14 and 16 are attached to the shaft 32, as will be hereinafter described. In FIG. 2, the mobile home 10 is shown with the I-beam 34 of the frame resting on foundation block 36. The strap 20 is connected to the I-beam 34 and the anchorhead 16. The strap 18 is connected to anchorhead 14 and passes over the top of the mobile home 10.

Figure 6:
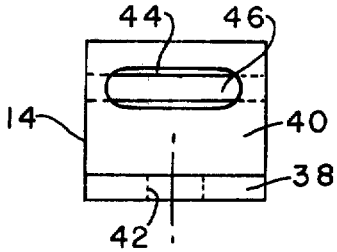
FIG. 6 is a detailed view of the anchorhead of the present invention.

The anchorhead 14 is illustrated in detail in FIG. 6. In this Figure, it can be seen that the anchorhead has a first flanged portion 38 and a second flanged portion 40. A bore 42 is provided in the flanged portion 38 and is of a size to allow the shaft 32 to extend therethrough. The flange 40 is provided with an elongated slot 44 extending therethrough with a bar 46 attached to the flange to extend across one side of the slot. In the head 14, the flanges 40 and 38 are orientated at right angles to each other. The anchorhead 16 is similar in construction except that the two flanges thereof are orientated at a different angle corresponding to the direction in which the strap 20 extends toward the beam 34.

The two anchorheads 14 and 16 are attached, as shown in FIG. 2, to shaft 32 by means of nuts 48. The straps 18 and 20 are attached to the respective anchorheads by inserting the strap through the slot 44 and around the bar 46 and back through the slot, as illustrated in FIG. 2.

Figure 7:
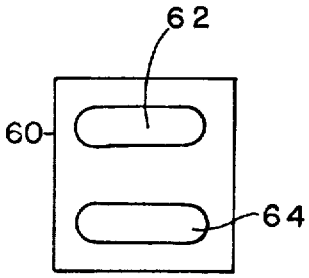
FIG. 7 is a detailed view of the strap buckle of the present invention utilized to attach the strap to the frame of the mobile home.

In FIG. 7, the buckle 60 is illustrated in detail as comprising a flat plate with a pair of spaced slots 62 and 64 therein. The use of the buckle 60 in attaching the strap 20 to the beam 34 of the frame is illustrated in FIG. 2. The extending end 66 of the strap 20 is first laid across the top of the I-beam 34 and then inserted through the slots 62 and 64. The strap 20 is then wrapped back around the buckle 60 and through slot 64 around the I-beam 34 and back through the slot 64 to extend down to an anchorhead 16.

According to a particular feature of the present invention, the lower portion 30 of the anchor is embedded in the ground as illustrated in FIG. 3. The lower portion 30 of the anchor comprises a pair of tubular portions 70 and 72 welded together with their center lines at 90° to each other and at 45° to the ultimate extension of the shaft 32. A nut 74 is welded between the tubular portions 70 and 72 by weld 76. The nut is of a size to receive in threaded engagement, the shaft 32 with the center line of the shaft in a line 45° to the center line of the tubes 70 and 72. A pair of pointed stakes 78 and 80 can be driven, respectively, into the tubular portions 70 and 72. It is important to note that the tubular portions 70 and 72 are embedded in the gound with the upper surface 82 and the nut 74 being flush with the surface of the ground so that when a vehicle is passed over the anchor with the shaft 32 disconnected, there is no protruding portion which could damage the wheels of the vehicle.

Figure 4:
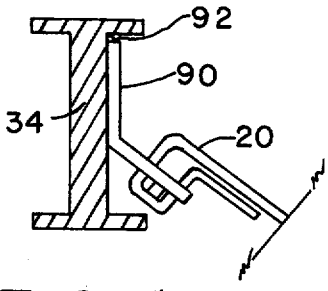
FIG. 4 illustrates one embodiment of attaching a strap to the frame of the present invention.
Figure 5:
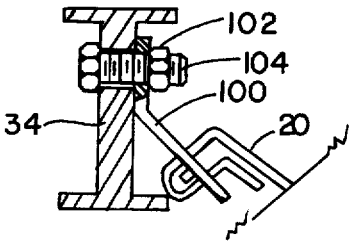
FIG. 5 illustrates a second embodiment of attaching a strap to the frame of the mobile home.

In FIGS. 4 and 5, alternate embodiments for attaching the strap 20 to the frame member 34 are shown. In FIG. 4, the connection member 90 similar in construction to anchorhead 16 is shown attaching the strap 20 to the frame 34. Member 90 has a pair of flanges as described with reference to anchorhead 14. The connecting member 90 is attached to the I-beam 34 by welding 92.

A similar embodiment is illustrated in FIG. 5 with a connection member 100 illustrated attaching the strap 20 to the frame member 34. In this embodiment, the connection member 100 is similar in construction to connection member 90 except that a bore 102 is formed in the connection member so that a nut and bolt assembly 104 can be used to rigidly attach the member 100 to the frame member.

Thus, it can be seen that the present invention discloses an improved anchor which can be disassembled to eliminate any protrusions above the surface of the ground to allow free passage of the mobile home or any towing vehicle thereover without damage to the tires or the vehicle.

It is to be understood, of course, that the foregoing disclosure relates only to preferred embodiments of the present invention and that numerous alterations and modifications can be made therein without departing from the spirit and scope of the invention as set forth in the appended claims.

I claim:

1. An anchoring apparatus comprising:

a body portion for embedding in the ground, said body portion comprising a pair of elongated hollow guides for receiving elongated drive anchors therein and a threaded socket provided on the upper portion of said body for positioning said socket flush with the ground surface, wherein said hollow guides are attached at an angle with respect to each other;

an elongated threaded shaft for releasably engaging said threaded socket; and anchorhead means for attaching a strap to said threaded shaft.

2. The apparatus of claim 1 wherein the centers of said hollow guides are at right angle to each other.

3. The apparatus of claim 1 wherein said anchorhead means comprises a rigid head with first and second flanges, a bore in one of the flanges with said shaft extending therethrough, and a fastener engaging said shaft to limit axial movement of said head therealong.

4. The apparatus of claim 1 additionally comprising a second anchorhead means for attaching a second strap to said shaft.

5. The apparatus of claim 1 wherein said socket and said guides are welded together.

* * * * *